US006412473B1

(12) United States Patent
Nan et al.

(10) Patent No.: US 6,412,473 B1
(45) Date of Patent: Jul. 2, 2002

(54) RATE SHAPED FLUID DRIVEN PISTON ASSEMBLY AND FUEL INJECTOR USING SAME

(75) Inventors: Xinshuang Nan; Ye Tian, both of Bloomington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/607,164

(22) Filed: Jun. 29, 2000

(51) Int. Cl.[7] ..... F02M 7/00
(52) U.S. Cl. ..... 123/446; 92/24
(58) Field of Search ..... 123/466, 447, 123/467, 496; 417/289, 399; 91/6, 25, 19, 24, 394, 400

(56) References Cited

U.S. PATENT DOCUMENTS

| | | | | |
|---|---|---|---|---|
| 2,794,397 A | | 6/1957 | Burman | |
| 2,880,675 A | | 4/1959 | Bessiere | |
| 3,838,943 A | | 10/1974 | Ulbing | |
| 4,046,112 A | | 9/1977 | Deckard | |
| 4,602,481 A | | 7/1986 | Robinson | |
| 5,456,581 A | | 10/1995 | Jokela et al. | |
| 5,662,087 A | | 9/1997 | McCandless | |
| 5,685,483 A | | 11/1997 | Ganser | |
| 5,769,319 A | | 6/1998 | Yen et al. | |
| 5,826,562 A | * | 10/1998 | Chen et al. | 123/446 |
| 6,053,421 A | * | 4/2000 | Chockley | 123/446 |
| 6,298,826 B1 | * | 10/2001 | Cotton, III | 123/446 |

* cited by examiner

*Primary Examiner*—Charles G. Freay
(74) *Attorney, Agent, or Firm*—Liell & McNeil; Michael B. McNeil

(57) ABSTRACT

A hydraulically actuated fuel injector includes an injector body that defines an actuation fluid passage, a low pressure area and a nozzle outlet. A piston having a hydraulic surface is positioned in the injector body and moveable a stroke distance between a retracted position and an advance position. At least one of the piston and injector body define a first cavity and a second cavity when the piston is located in an initial portion of its stroke distance. Before a first portion of the hydraulic surface is exposed to fluid pressure in the first cavity, and a second portion of the hydraulic surface is exposed to fluid pressure in the second cavity when the piston is in its initial portion of its stroke distance. A valve is positioned in the injector body and has an open position that fluidly connects the second cavity to the low pressure area when the piston is located in the initial portion of its stroke distance, and a closed position when the piston is located away from the initial portion of the stroke distance.

20 Claims, 2 Drawing Sheets

RATE SHAPED FLUID DRIVEN PISTON ASSEMBLY AND FUEL INJECTOR USING SAME

TECHNICAL FIELD

The present invention relates generally to fluid driven piston assemblies, and more particularly to rate shaped fluid driven piston assemblies utilized in hydraulically actuated fuel injectors.

BACKGROUND ART

In one class of fuel injectors, a hydraulically driven piston assembly is utilized to raise fuel pressure to injection levels before and during an injection event. In a typical example, a relatively large diameter piston is acted upon by working fluid pressure to drive a relatively small diameter plunger that acts upon fuel to pressurize the same. Since the piston has a relatively large diameter compared to the plunger, these hydraulically actuated fuel injectors are considered to be pressure intensified systems since the fuel pressure is raised to many times that of the working fluid pressure because of the differing hydraulic surface areas. Thus, in these devices, the fuel injection pressure corresponds generally to the area ratio between the plunger and piston, and the pressure of the working fluid acting on the piston. While hydraulically actuated fuel injectors of this type have performed well for many years, engineers are constantly looking for ways to improve the same.

Over the years, engineers have discovered that emissions can be significantly reduced at certain operating conditions by providing a particular injection rate shape. In many cases, emissions can be improved when the initial injection rate is controllable, and when there is a nearly vertical abrupt end to an injection event. One strategy for introducing front end rate shaping into hydraulically actuated fuel injectors is discussed in co-owned U.S. Pat. No. 5,826,562 to Chen et al. This patent recognizes that some front end rate shaping, such as ramp and boot shapes, can be accomplished by initially exposing only a portion of the piston to the high pressure working fluid during an injection event, and then later exposing its complete hydraulic surface to the working fluid pressure during the main portion of an injection event. In a typical example of a rate shaped fuel injector of this type, the piston and its bore are modified to include concentric step portions. When the piston is in its retracted position immediately proceeding an injection event, only a central relatively small area portion of the piston is exposed to the working fluid pressure. After the piston has moved through an initial portion of its downward stroke, its central top hat portion clears a small diameter portion of the piston bore to expose the complete upper hydraulic surface of the piston to the working fluid pressure. Thus, when in operation, the piston initially moves relatively slowly to produce a relatively low injection rate and then later during its stroke it accelerates for the main injection event at significantly higher injection rates. While this rate shaping strategy has proven successful, there remains room for improvement.

In order for a stepped top piston to reliably produce rate shaping, the relatively large shoulder hydraulic surface area of the piston is preferably exposed to a known and relatively constant low pressure during the initial stroke of the piston. If the fluid pressure on the outer shoulder area of the piston can not be maintained at a relatively low known pressure during the initial portion of the injection event, then little or no rate shaping can be accomplished. Because the volume above the shoulder area of the piston must necessarily grow as the piston moves during its downward stroke, there must be some means provided for channeling fluid into this space in order to allow the piston to move in a known manner without being inhibited by vacuum effects or damaged due to a possible cavitation effects. Because fluid flow to the shoulder area is at least partially a function of a diametrical clearance between the top hat portion of the piston and its small diameter piston bore, some variation between injectors is possible due to the necessity to accept realistic machining tolerances on the two separate components. Thus, while the rate shaping concept has been proven successful, there remains room for improving the consistency between multiple injectors. In other words, there remains room for decreasing performance variations between injectors at least in part by decreasing the sensitivity of injector performance to dimensional variations in mass produced parts that are a necessity in almost any mechanical multi-component mechanical device.

The present invention is directed to overcoming these and other problems and to improving upon the predictability of injector performance and to decreasing variations in performance from one injector to another.

DISCLOSURE OF THE INVENTION

A fluid driven piston assembly comprises a body that defines a piston bore, a low pressure area and an actuation fluid passage. The piston has a hydraulic surface and is positioned in the piston bore. It is moveable a stroke distance between a retracted position and an advanced position. The hydraulic surface can be divided into a first hydraulic surface and a second hydraulic surface. The first hydraulic surface is exposed to fluid pressure in the actuation fluid passage over the stroke distance, but the second hydraulic surface is exposed to fluid pressure in the low pressure area over an initial portion of the stroke distance. The second hydraulic surface is exposed to fluid pressure in the actuation fluid passage over a different portion of the stroke distance.

BEST MODE OF CARRYING OUT THE INVENTION

Figure 1:
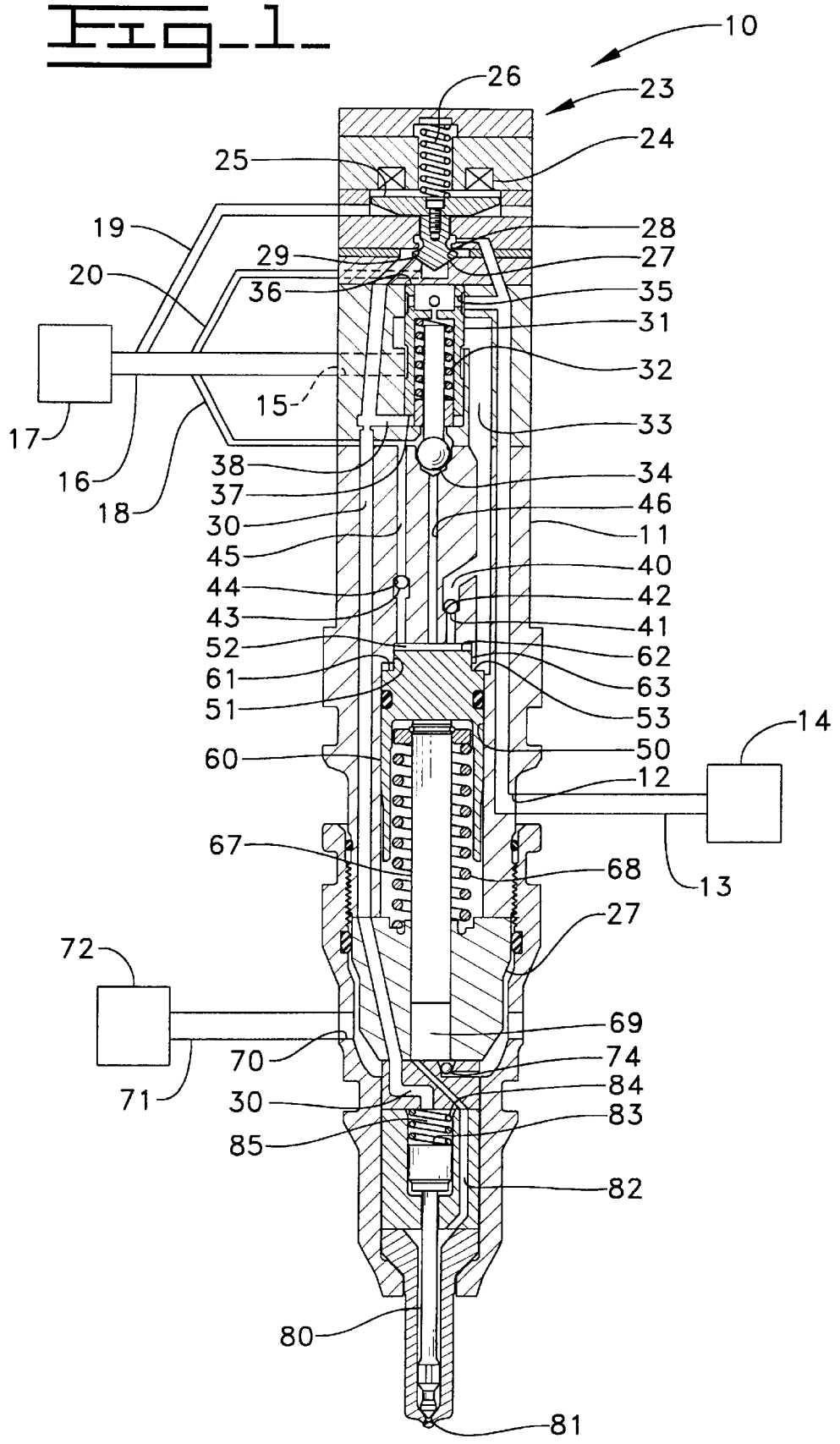
FIG. 1 is a sectioned side diagrammatic view of a hydraulically actuated fuel injector according to the present invention.
Figure 2:
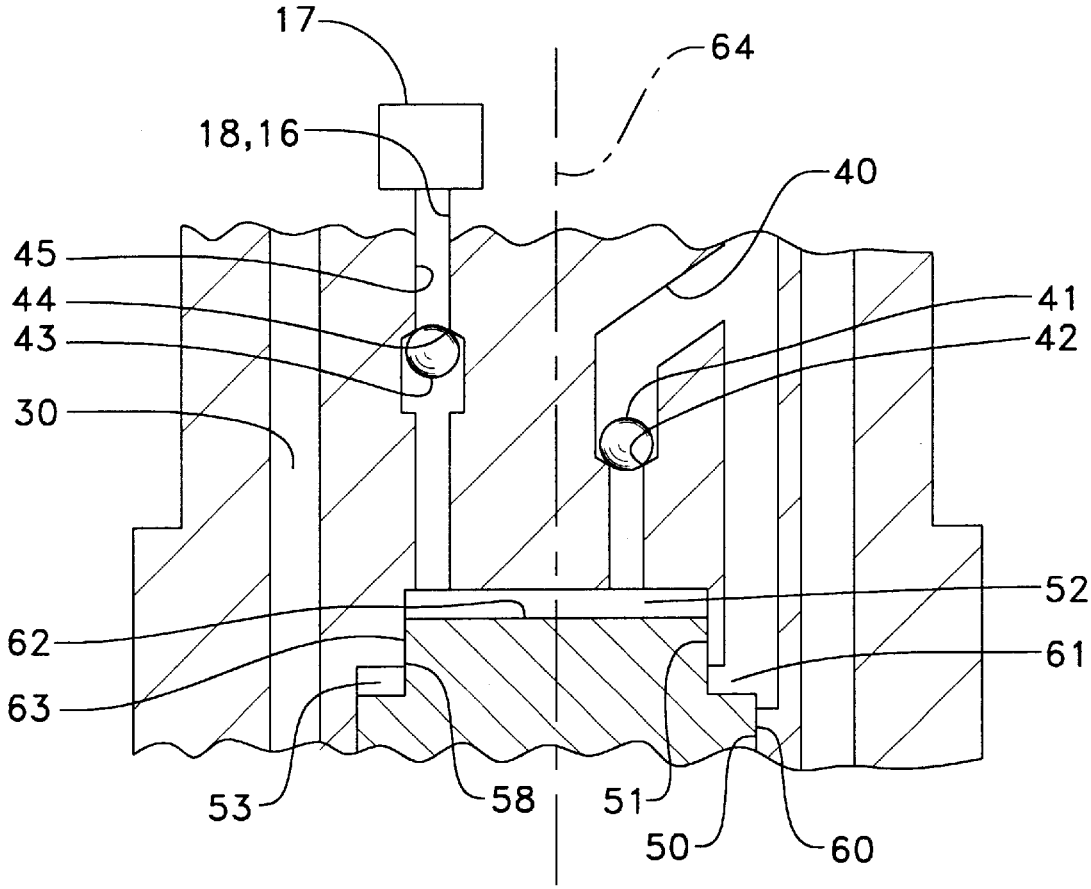
FIG. 2 is an enlarged sectioned side diagrammatic view of the fluid driven piston assembly portion of the fuel infector shown in FIG. 1.

Referring now to FIG. 1, a hydraulically actuated fuel injector 10 includes an injector body 11 that defines an actuation fluid inlet 12, an actuation fluid drain 15, a fuel inlet 70 and a nozzle outlet 81. Actuation fluid inlet 12 is connected to a source of high pressure actuation fluid 14, such as lubricating oil, via an actuation fluid supply line 13. Actuation fluid drain 15 is connected to a low pressure reservoir 17, such as an engine oil sump, via a low pressure passage 6. Various internal venting passages defined by injector body 11 are also connected to low pressure passage 16. These include a pressure relief vent 18, an armature cavity vent 19, and a control pressure vent 20. The fuel inlet 70 is connected to a source of fuel 72, such as distillate diesel fuel, via a fuel supply line 71. When installed in an internal combustion engine, the nozzle outlet 81 is preferably positioned in an appropriate location to promote efficient combustion within an individual engine cylinder. Fuel injector 10 is controlled in its operation by an electrical actuator 23, which is preferably a solenoid, but could be any suitable electrical actuator, such as piezzo electric actuator.

Electrical actuator 23, which in this case is a solenoid, includes a coil 24 and a moveable armature 25 that is attached to a pilot valve member 27 in a conventional manner. Armature 25 and pilot valve member 27 are normally biased downward to close a low pressure seat 28 by a biasing spring 26. When in this lower biased position, coil 24 is de-energized and a high pressure seat 29 is open such that a pressure control passage 30 is fluidly connected to high pressure actuation fluid inlet 12. When solenoid 23 is energized, armature 25 and pilot valve member 27 are lifted upward to open low pressure seat 28 and close high pressure seat 29. When this occurs, pressure control passage 30 is exposed to the low pressure in control pressure vent 20. The positioning of pilot valve member 27 controls both the positioning of a spool valve member 31, which controls fluid flow to the intensifier piston 60, and also controls the positioning of a direct control needle valve 80.

Spool valve member 31 is positioned in injector body 11 and is biased toward an upward position by a spool biasing spring 32. When in this upward position, an actuation fluid flow passage 33 is fluidly connected to actuation fluid drain 15 via an annulus machined on the outer surface of spool valve member 31. The hollow interior of spool valve member 31 is always exposed to high pressure actuation fluid inlet 12 via a plurality of radial passages 35. This fluid connection also causes an upper end 36 of spool valve member 31 to always be exposed to the high pressure of actuation fluid inlet 12. Spool valve member 31 also includes a lower end 37 that is exposed to fluid pressure in a branch control passage 38 that connects to pressure control passage 30, which was discussed earlier. When pressure in control passage 30 is high, spool valve member 31 is preferably hydraulically balanced such that it remains at, or moves toward, its upward position, as shown, via the action of spool biasing spring 32. When pressure in control passage 30 is low, by an appropriate positioning of pilot valve member 27, the hydraulic force acting on upper end 36 overcomes spring 32 causing spool valve member 31 to move downward toward its lower position. When in its lower position, actuation fluid drain 15 closes, but actuation fluid flow passage 33 becomes connected to actuation fluid inlet 12 via the annulus located adjacent to radial passages 35.

When actuation fluid flow passage 33 is fluidly connected to actuation fluid inlet 12, the intensifier piston 60 is hydraulically driven downward to pressurize fuel in a fuel pressurization chamber 69 to initiate an injection event. Piston 60 moves in a piston bore that includes a main bore 50 and a relatively small diameter upper piston bore 51. Piston 60 includes a top hydraulic surface that can be considered as being separated into a small hydraulic surface 61 and a relatively large hydraulic surface 62 when piston 60 is in its retracted position as shown. Small hydraulic surface 61 is preferably concentric with large hydraulic surface 62 about a centerline 64. The hydraulic surfaces are sized such that piston 60 and plunger 67 will begin moving downward due to the hydraulic force acting on small hydraulic surface 61. Piston 60 is normally biased toward its upward retracted position, as shown, by a return spring 68. When in this upward retracted position, piston 60 and injector body 11 define an upper cavity 52 and a lower cavity 53 that are substantially fluidly isolated from one another except for a spill passage 40 and an annular clearance area that exists between top hat portions 63 and the inner diameter of small bore 51.

Small hydraulic surface 61 is always exposed to fluid pressure in flow passage 33 throughout the stroke distance of piston 60 between its retracted position and its downward advance position. Upper cavity 52, on the other hand, is fluidly connected to pressure relief vent 18 via both a low pressure passage 45 and a pressure relief passage 46. Low pressure passage 45 includes a check valve 43 with a valve seat 44 positioned between a ball valve member and pressure relief vent 18. A pressure relief ball 34 is positioned in pressure relief passage 46, and includes a conical valve seat position between ball 34 and upper cavity 52. Upper cavity 52 is also fluidly connected to flow passage 33 via spill passage 40, which includes a check valve 41 and a valve seat 42 positioned between the ball valve member and upper cavity 52. Check valve 43 will preferably remain in a closed position whenever pressure in upper cavity 52 exceeds that in low pressure relief vent 18. Check valve 41 will preferably remain in a closed position whenever the pressure in passage 33 exceeds the fluid pressure in upper cavity 52. Pressure relief ball 34 on the other hand, will be held in its downward closed position whenever spool valve member 60 is in its downward position in contact with an intervening pin that holds pressure relief ball valve member 34 in its downward seated position to close pressure relief passage 46.

During the initial portion of an injection event, when piston 60 begins moving downward from its retracted position, pressure relief ball valve member 34 is seated to close pressure relief passage 46, check valve 41 is closed, but check valve 44 is open to allow fluid to flow from vent 18 into upper cavity 52, which grows in volume as piston 60 moves downward. When piston 60 moves past an initial portion of its stroke distance, the top hat portion 63 clears annular edge 58 to expose the complete top hydraulic surface of piston 60 to fluid pressure in flow passage 33.

When piston 60 is hydraulically driven downward, it moves a plunger 67 to pressurize fuel in a fuel pressurization chamber 69. Because of the different sizes of the piston 60 and plunger 67, the fuel in fuel pressurization chamber 69 can be raised to many times of that of the actuation fluid pressure entering at inlet 12. During an injection event, high pressure fuel flows from fuel pressurization chamber 69 through a nozzle supply line 82 and out of nozzle outlet 81 when direct control needle valve 80 is in its upward open position. Between injection events, low pressure fuel is drawn into fuel pressurization chamber 69 past a check valve 74.

Direct control needle valve 80 includes a closing hydraulic surface 83 that is exposed to fluid pressure in a needle control chamber 85, which is fluidly connected to pressure control chamber 30. Direct control needle valve 80 is also mechanically biased downward toward its closed position by a needle biasing spring 84. Various fluid pressures and hydraulic surfaces, including closing hydraulic surface 83, are sized such that direct control needle valve 80 will move toward, or remain in, its downward closed position when pressure in pressure control passage 30 is high. These are such that direct control needle valve 80 can be maintained in its downward closed position even when high pressure exists in fuel pressurization chamber 69. When pressure in control passage 30 is low, and fuel pressure in nozzle supply line 82 is above a valve opening pressure sufficient to overcome biasing spring 84, direct control needle valve 80 will move upward to its open position to open nozzle outlet 81.

INDUSTRIAL APPLICABILITY

Just prior to an injection event, solenoid 23 is de-energized, pilot valve member 27 is in its downward position closing low pressure seat 28, spool valve member 31 is in its upward position, as shown, piston 60 and plunger 67 are in their upward retracted positions, as shown, and direct control needle valve 80 is in its downward closed position. When the various internal moveable components are in these respective positions, high pressure prevails in pressure control passage 30, low pressure prevails in actuation fluid flow passage 33, and fuel pressure in fuel pressurization chamber 69 is low. Each infection event is initiated by energizing solenoid 23 to lift pilot valve member 27 upward to close high pressure seat 29 and open low pressure seat 28. When this occurs, pressure in control passage 30 drops to a relatively low level. When this happens, pressure is relieved on lower end 37 of spool valve member 31, causing it to begin moving downward under the hydraulic force acting on upper end 36. Piston 60 and plunger 67 remain in their retracted positions and direct control needle valve 80 remains in its downward position under the action of spring 84.

As spool valve member 31 continues moving downward, it closes actuation fluid drain 15, and shortly thereafter, opens actuation fluid flow passage 33 to actuation fluid inlet 12 via the annulus located adjacent to radial passages 36. At this time, pressure in upper cavity 52 is low. When flow passage 33 becomes fluidly connected to actuation fluid inlet 12, high pressure immediately begins acting on small hydraulic surface 61 and check valve 41 closes since the pressure in flow passage 33 is now far greater than the low pressure existing in upper cavity 52. When this occurs, low pressure actuation fluid is drawn into upper cavity 52 past check valve 43 so that large hydraulic surface 62 sees a relatively low and known pressure existing in vent 18. Because upper cavity 52 is in direct fluid communication with vent 18 at this time, pressure in upper cavity 52 remains at a relatively known low level even if some high pressure actuation fluid flows into the upper cavity past the clearance area existing between top hat portion 63 and small bore 51. Thus, the effort to maintain pressure in upper cavity 52 relatively low during this initial portion of the stroke distance of piston 60 is greatly desensitized to any variation in clearance areas that may exist between different injectors due to inevitable machining tolerances for the top hat portion 63 and the small bore 51.

As piston 60 continues moving downward, fuel pressure in fuel pressurization chamber 69 eventually exceeds the valve opening pressure of direct control needle valve 80 and it lifts upward to commence the spraying of fuel into the combustion space. While top hat 63 moves in small bore 52, only a relatively small portion of piston 60 is being acted upon by the high pressure actuation fluid. As a result, the injection pressure is relatively low, which could correspond to the toe portion of a boot shaped injection event.

As piston 60 continues its downward movement, top hat portion 63 clears annular edge 58 causing the complete hydraulic surface to then become exposed to the high fluid pressure in flow passage 33. When this occurs, piston 60 and plunger 67 accelerate in their downward movement, and fuel pressure rises to main injection levels. This portion of the piston's stroke corresponds to the main injection portion of the injection event. During this portion of the injection sequence, check valve 43 closes because the piston bore is fully communicating with passage 33, and pressure relief ball 34 remains in its closed position.

Shortly before the desired amount of fuel has been injected, solenoid 23 is de-energized to allow pilot valve member 27 to move downward to close low pressure seat 28 and reopen high pressure seat 29. When this occurs, high pressure resumes in control passage 30 to act on closing hydraulic surface 83 to move direct control needle valve 80 downward to close nozzle outlet 81. At about the same time, high pressure resumes on lower end 37 of spool valve member 31, so that it begins moving toward its upward position under the action of spring 32. Spool valve member 31 is assisted in its movement toward its upward position by residual high pressure in the cavity above piston 60 acting through pressure relief passage 46 to push relief ball 34 upward to its open position. When pressure relief ball 34 is moved toward its upper position, an intervening pin acts to push spool valve member 31 toward its upward position. At the same time, when pressure relief ball 34 is lifted off its seat, residual pressure acting on piston 60 is quickly relieved into vent 18. When spool valve member 31 approaches its upward position, actuation fluid drain 15 reopens to flow passage 33. When this occurs, plunger 67 and piston 60 begin retracting under the action of return spring 68. This causes fresh low pressure fuel to be drawn into fuel pressurization chamber 69, and the used actuation fluid to be displaced into drain 15 for possible recirculation.

Those skilled in the art will appreciate that pilot valve member 27 and solenoid 23 are preferably a relatively fast acting pair compared to the movement rate of spool valve member 31. This hysteresis relationship can permit the production of split injection events by briefly de-energizing solenoid 23 during the beginning portion of an injection event to briefly close direct control needle valve 80. This is done before spool valve member 31 can move far enough to close the fluid connection between flow passage 33 and actuation fluid inlet 12. Before spool valve member 31 can move too far, solenoid 23 is re-energized to resume the main portion of an injection event.

Because the valuing and plumbing of the present invention allows the relatively large hydraulic surface 62 located in upper cavity 52 to be exposed to a known low pressure during the initial stroke distance of piston 60, variations in injector performance from one injector to another can be significantly reduced. In other words, any fluid flow that occurs between top hat 63 and small bore 51 during this initial portion of the piston's movement will inevitably vary from injector to injector due to the need to apply realistic machining tolerances to both the piston 60 and the small bore 51. However, because the upper cavity 52 is fluidly connected to a low pressure area 17 via a vent 18, any fluid flow in this clearance area will no significantly change the relatively low pressure existing in the upper cavity 52. Thus, injectors can be manufactured with realistic machining tolerances which inevitably result in some geometric variations, but the performance variations between injectors is greatly desensitized to these dimensional differences among injectors.

The present invention has been illustrated in the context of a top hat type piston in which the small hydraulic surface substantially surrounds the inner large hydraulic surface. However, the principles of the present invention would also be applicable to top hat pistons in which the small hydraulic surface area is surrounded by the relatively large hydraulic surface area as in many fuel injectors of this type currently being manufactured by Caterpillar, Inc. of Peoria, Ill. Other shaped pistons could also benefit. It should also be pointed out that the inclusion of spill passage 40 and check valve 41 could be eliminated without altering the function of the invention provided some means existed for displacing fluid from upper cavity 52 when piston 60 approaches its retracted position. In other words, check valve 41 only opens to allow fluid to be displaced from upper cavity 52 during the last portion of the piston's stroke toward its retracted position. Some other means could be provided for allowing this fluid to be displaced, such as by providing check valve 43 with a slight spring bias toward its open position, and/or by providing adequate clearance between top hat portion 63 and small bore 51 that piston 60 could complete its movement toward its retracted position between injection events, or some other plumbing strategy that allows the fluid in the upper cavity to be evacuated.

It should be understood that the above description is intended only to illustrate the concepts of the present invention, and is not intended to in any way limit the potential scope of the present invention. Those skilled in the art will appreciate that various modifications could be made to the illustrated embodiment without departing from the contemplated scope of the invention, which is defined by the claims set forth below.

What is claimed is:

1. A fluid driven piston assembly comprising:

a body defining a piston bore, a low pressure passage and an actuation fluid passage;

a piston having a hydraulic surface and being positioned in said piston bore and being moveable a stroke distance between a retracted position and an advanced position;

said hydraulic surface including a first hydraulic surface and a second hydraulic surface;

said first hydraulic surface being exposed to fluid pressure in said actuation fluid passage over said stroke distance; and said second hydraulic surface being exposed to fluid pressure in said low pressure passage over an initial portion of said stroke distance, but being exposed to fluid pressure in said actuation fluid passage over a different portion of said stroke distance.

2. The fluid driven piston assembly of claim 1 wherein said second hydraulic surface has a larger effective area than said first hydraulic surface.

3. The fluid driven piston of claim 1 wherein said first hydraulic surface and said second hydraulic surface are concentric.

4. The fluid driven piston of claim 3 wherein said first hydraulic surface surrounds said second hydraulic surface about a common centerline.

5. A fluid driven piston assembly comprising:

a body defining a piston bore, a low pressure area and an actuation fluid passage;

a piston having a hydraulic surface and being positioned in said piston bore and being moveable a stroke distance between a retracted position and an advanced position;

said hydraulic surface including a first hydraulic surface and a second hydraulic surface;

said first hydraulic surface being exposed to fluid pressure in said actuation fluid passage over said stroke distance;

said second hydraulic surface being exposed to fluid pressure in said low pressure area over an initial portion of said stroke distance, but being exposed to fluid pressure in said actuation fluid passage over a different portion of said stroke distance; and a valve positioned in said body between said low pressure area and said second hydraulic surface, and said valve having an open position in which said second hydraulic surface is exposed to fluid pressure in said low pressure area, and a closed position in which said second hydraulic surface is fluidly isolated from said low pressure area.

6. The fluid driven piston assembly of claim 5 wherein said valve includes a ball valve member and an annular valve seat positioned between said ball valve member and said low pressure area.

7. A fluid driven piston assembly comprising:

a body defining a piston bore, a low pressure area and an actuation fluid passage;

a piston having a hydraulic surface and being positioned in said piston bore and being moveable a stroke distance between a retracted position and an advanced position;

said hydraulic surface including a first hydraulic surface and a second hydraulic surface;

said first hydraulic surface being exposed to fluid pressure in said actuation fluid passage over said stroke distance;

said second hydraulic surface being exposed to fluid pressure in said low pressure area over an initial portion of said stroke distance, but being exposed to fluid pressure in said actuation fluid passage over a different portion of said stroke distance;

at least one of said body and said second hydraulic surface define a fluid volume when said piston is located in said initial portion of said stroke distance;

said body defining a spill passage fluidly connected to said fluid volume; and a spill valve positioned in said spill passage and being moveable between an open position and a closed position.

8. The fluid driven piston of claim 7 wherein said spill valve includes a ball valve member and a valve seat positioned between said ball valve member and said fluid volume.

9. A fluid driven piston assembly comprising:

a body defining a piston bore, a low pressure area and an actuation fluid passage;

a piston having a hydraulic surface and being positioned in said piston bore and being moveable a stroke distance between a retracted position and an advanced position;

said hydraulic surface including a first hydraulic surface and a second hydraulic surface;

said first hydraulic surface being exposed to fluid pressure in said actuation fluid passage over said stroke distance;

said second hydraulic surface being exposed to fluid pressure in said low pressure area over an initial portion of said stroke distance, but being exposed to fluid pressure in said actuation fluid passage over a different portion of said stroke distance; and at least one of said body and said second hydraulic surface define a fluid volume when said piston is located in said initial portion of said stroke distance;

at least one valve positioned in said body having an open position in which said fluid volume is fluidly connected to one of said actuation fluid passage and said low pressure area when said piston is in said initial portion of said stroke distance, and a closed position when said piston is in said different portion of said stroke distance.

10. A hydraulically actuated fuel injector comprising:

an injector body defining an actuation fluid passage, a low pressure area and a nozzle outlet;

a piston having a hydraulic surface and being positioned in said injector body and being moveable a stroke distance between a retracted position and an advanced position;

at least one of said piston and said injector body defining a first cavity and a second cavity when said piston is located in an initial portion of said stroke distance;

a first portion of said hydraulic surface being exposed to fluid pressure in said first cavity, and a second portion of said hydraulic surface being exposed to fluid pressure in said second cavity when said piston is in said initial portion of said stroke distance; and a valve positioned in said injector body and having an open position that fluidly connects said second cavity to said low pressure area when said piston is located in said initial portion of said stroke distance, and a closed position when said piston is located away from said initial portion of said stroke distance.

11. The fuel injector of claim 10 wherein said valve is a check valve that includes a ball valve member and a valve seat positioned between said ball valve member and said low pressure area.

12. The fuel injector of claim 10 wherein said piston has a centerline; and said first portion and said second portion of said hydraulic surface are concentric and spaced apart along said centerline.

13. The fuel injector of claim 10 wherein said second portion of said hydraulic surface has a larger effective area than said first portion of said hydraulic surface.

14. The fuel injector of claim 10 wherein said injector body defines a spill passage extending between said second cavity and said actuation fluid passage; and a spill valve positioned in said spill passage and having a closed position and an open position, and said spill valve being biased toward said closed position when fluid pressure in said actuation fluid passage is greater than fluid pressure in said second cavity.

15. The fuel injector of claim 10 wherein said first portion of said hydraulic surface is exposed to fluid pressure in said actuation fluid passage over said stroke distance.

16. The fuel injector of claim 10 wherein said injector body defines a fuel inlet connected to a source of fuel that is different from an actuation fluid in said actuation fluid passage.

17. A hydraulically actuated fuel injector comprising:

an injector body defining an actuation fluid passage, a low pressure area and a nozzle outlet;

a piston having a hydraulic surface and being positioned in said injector body and being moveable a stroke distance between a retracted position and an advanced position;

at least one of said piston and said injector body defining a first cavity and a second cavity when said piston is located in an initial portion of said stroke distance that begins at said retracted position;

a first portion of said hydraulic surface being exposed to fluid pressure in said first cavity, and a second portion of said hydraulic surface being exposed to fluid pressure in said second cavity when said piston is in said initial portion of said stroke distance, and said hydraulic surface being exposed to fluid pressure in said actuation fluid passage when said piston is located away from said initial portion of said stroke distance;

said injector body defining a low pressure passage extending between said second cavity and said low pressure area; and a check valve positioned in said low pressure passage.

18. The fuel injector of claim 17 wherein said piston has a centerline; and said first portion and said second portion of said hydraulic surface are concentric and spaced apart along said centerline.

19. The fuel injector of claim 18 wherein said second portion of said hydraulic surface has a larger effective area than said first portion of said hydraulic surface.

20. The fuel injector of claim 19 wherein said injector body defines a spill passage extending between said second cavity and said actuation fluid passage; and a spill check valve positioned in said spill passage.

* * * * *